US005823632A

United States Patent [19]

Burkett

[11] Patent Number: 5,823,632

[45] Date of Patent: Oct. 20, 1998

[54] SELF-SHARPENING NOSEPIECE WITH SKIRT FOR ATTACK TOOLS

[76] Inventor: Kenneth H. Burkett, 410½ Main St., Benton, Ill. 62812

[21] Appl. No.: 661,317

[22] Filed: Jun. 13, 1996

[51] Int. Cl.[6] ..... E21C 35/183

[52] U.S. Cl. ..... 299/104; 299/111

[58] Field of Search ..... 299/104, 111, 299/113

[56] References Cited

U.S. PATENT DOCUMENTS

| | | | |
|---|---|---|---|
| 4,497,520 | 2/1985 | Ojanen | 299/111 |
| 4,682,987 | 7/1987 | Brady et al. | 51/293 |
| 4,911,503 | 3/1990 | Stiffler | 299/111 |
| 4,981,328 | 1/1991 | Stiffler et al. | 299/111 |
| 5,141,289 | 8/1992 | Stiffler | 299/111 |
| 5,161,627 | 11/1992 | Burkett | 299/111 |
| 5,161,859 | 11/1992 | Larsson et al. | 299/111 |
| 5,484,191 | 1/1996 | Sollami | 299/111 X |

FOREIGN PATENT DOCUMENTS

| | | | |
|---|---|---|---|
| 3500261 | 7/1986 | Germany | 299/104 |
| 3818213 | 11/1989 | Germany | 299/104 |
| 1102936 | 7/1984 | U.S.S.R. | 299/104 |
| 2004315 | 3/1979 | United Kingdom | 299/104 |
| 2037223 | 7/1980 | United Kingdom | 299/104 |
| 2146058 | 4/1985 | United Kingdom . | |
| 2180280 | 3/1987 | United Kingdom . | |

*Primary Examiner*—David J. Bagnell
*Attorney, Agent, or Firm*—Haverstock, Garrett & Roberts

[57] ABSTRACT

A self-sharpening nosepiece with skirt construction for attack tools including a nosepiece which replaces a conventional cutting element on the tip of the work engaging end of the tool to provide improved longevity and cutting characteristics and produce less dust, and a skirt which overlays portions of the side of the work engaging end of the tool and the nosepiece to support the nosepiece and to prevent the erosion of the tool and the dislodgment and loss of the nosepiece, the present nosepiece and skirt construction being adapted for use with attack tools for mining, excavating, removing highway road surfaces and the like, and optionally including a layer of a super hard material on the outer surfaces thereof to provide even greater wearability and durability.

20 Claims, 4 Drawing Sheets

SELF-SHARPENING NOSEPIECE WITH SKIRT FOR ATTACK TOOLS

The present invention relates generally to tools known as attack tools used for such purposes as mining, excavating and removing highway road surfaces and the like, and, more particularly, to a nosepiece and skirt for installation on the forward earth or work engaging end of a mining or other attack tool which provide has a nosepiece portion that effectively self-sharpens as it wears so as to cut better longer with production of less respirable dust, and which has an attached skirt portion that protects the side of the tool from abrasion and erosion as the tool moves through the mined or otherwise loosened material and provides improved attachment to the tool to prevent dislodgment and loss of the nosepiece. The present invention can furthermore include an optional diamond or other super hard coating or layer on the outer work engaging surfaces thereof to provide even greater cutting effectiveness and longevity.

BACKGROUND OF THE INVENTION

Attack tools used on machines for mining, excavating, removing road surfaces, and the like are subject to tremendous forces generated by the forward or thrusting movement of the mining or other machine into the surface being removed, which tends to compress and crush the tools, and by the rotation of a drum or wheel on which the tools are mounted, resulting in blunted, worn and broken tools which decrease the efficiency and productivity of the mining or other operation, produce poorer quality mined or excavated product, require more frequent machine downtime for replacement, and additionally and importantly result in increased generation of respirable dust which is highly undesirable as it can be inhaled by mine workers. Dull and broken tools can also cause more sparking which in mines can ignite methane gas that may be present. The use of cutting elements such as replaceable tips, caps, inserts, buttons and the like made from hard materials such as carbide and which mount in sockets or receptacles on the forward or work engaging ends of attack tools to increase the life of such tools is well known in the art. Reference in this regard U.K. Patent Publication Serial NO. 2180 280 A, which discloses a button insert having a truncated conical shaped cutting tip. More recent advancements in the art have even further increased the effective longevity of such replaceable tips and inserts. One such advancement is the use of a layer of polycrystalline diamond (PCD) on the outer work engaging surface of an insert or tip, as disclosed in my U.S. Pat. No. 5,161,627. A limitation, however, with the use of such harder inserts and tips including the truncated conical cutting tip and my PCD inserts referenced above, include a still less than ideal cutting ability and resultant relatively high level of dust production due to the relatively short and wide or blunt shape of the tips. Other limitations include the use of a relatively deep socket or receptacle for holding the inserts which means that only a small portion of the inserts are used for cutting, and the potential dislodgment and loss of the inserts when the inserts, which are very hard and durable, outlast the tool bodies that support them, which tool bodies are generally made from a softer material such as steel. This problem is known in the industry as "wash-out" and it results from the gradual erosion or wearing down of the forwardly and/or sidewardly facing surfaces of the tool body until inadequate material remains for supporting and retaining the insert or tip. Washed-out tools result in reduced productivity due primarily to the less effective cutting capability of the tools without the inserts and the downtime required for replacement of the tools.

To overcome some of the shortcomings relating to wash-out at least to some degree, improved replaceable insert and tip constructions have been developed. For instance, reference is made to U.S. Pat. No. 5,161,859, which discloses a cutting insert for excavating tools having a shape that provides a sidewardly extending shoulder around the base of the insert. Reference is made to U.S. Pat. No. 5,141,289, which discloses a cemented carbide tip for cutting tools which provides a sidewardly and more rearwardly extending bell shaped portion around the base of the tip. Importantly however, these and the other known similarly shaped prior art constructions, while adequately protecting the forward facing surface of the tool from erosion, have been found to provide only limited additional support for the insert and protection from wash-out of the sides of the tool body so as to still be dislodged and lost more frequently than desired. The tools also have work engaging portions that have been found to dull or blunt relatively soon such that the tools cut less effectively and produce a higher than desirable level of respirable dust. Reference is made to U.S. Pat. No. 4,682,987, which discloses a different approach which is the use of a hard surface coating of a metal alloy composition on wear surfaces adjacent to the forward or work engaging end of a tool body to provide improved resistance to wash-out. However, surface coatings such as this have been found to provide only limited improvement in wearability and do not provide any improved means for securing or locking the insert or tip onto the tool.

SUMMARY OF THE INVENTION

The present invention overcomes many of the above-described shortcomings and limitations of the prior art and teaches the construction and operation of a combined nosepiece and skirt for attack tools for mining, excavating, and the like, the nosepiece portion of which importantly retains its shape as it wears so as to effectively self-sharpen instead of dulling or blunting to provide a longer lasting improved cutting capability with production of less respirable dust, and the skirt portion better protects the nosepiece portion from wash-out, and provides more secure attachment to the tool. The nosepiece portion mounts or attaches to the forward earth or work engaging end of the body of a tool and the skirt portions covers the sides of the tool body to provide the improved wash-out protection from the side where the prior art tools have been found to be lacking. The skirt also serves to lock and secure the nosepiece in position on the tool to allow more of the nosepiece to be exposed and available for cutting. Resultant benefits observed with use of the present nosepiece and skirt construction include longer intervals between tool changes, better quality mined product, less power consumption, and fewer sparks with the potential to ignite methane gas that may be present in a mine. The present nosepiece and skirt construction can furthermore be provided with a coating or layer of a diamond material or other hard material on the outer work engaging surfaces thereof for even greater durability.

The preferred nosepiece portion of the present invention has a forwardly extending earth or working engaging end providing a cutting element and an opposite rear end, the work engaging end having an elongated shape including a smaller forwardmost tip having a curved or rounded outer shape and a concave outer side surface extending from the rounded tip to the rearward end, the outer side surface having a gently or gradually curved shape that curves more radially outwardly adjacent the rearward end. The skirt portion extends rearwardly from the rear end of the nosepiece portion. The preferred skirt is an annular shaped member that overlays the mounting surfaces of the nosepiece and a portion of the outer side surface of the tool body, and has a frusto-conical shaped outer surface that extends rearwardly and radially outwardly from the nosepiece portion. The combination of the shape of the nosepiece and presence of the skirt around the mounting surfaces and sides of the tool body is an important feature of the present invention, as the smaller curved or rounded tip and concave outer surface give the nosepiece an elongated and relatively narrow profile that provides a cleaner, deeper penetration capability and retains its basic shape as it wears, while the skirt provides protection from erosion for the underlying side surfaces of the tool body at least for the life of the nosepiece and securely holds the nosepiece in place. Also importantly, the preferred mounting surfaces of the present nosepiece and skirt include a rearwardly extending button or post surrounded by a an annular groove adapted for receiving an upstanding or outwardly extending annular side wall portion or raised lip on the end of the tool body. This mounting surface construction is important as it provides increased surface area for attachment of the nosepiece and skirt to the tool body utilizing a suitable brazing material, and the raised lip is particularly important to provide the support and strength necessary to prevent dislodgment of the nosepiece and skirt under the sideward, oblique, and shear forces acting thereon as a result of the cutting action and angle of attack of the tool.

The preferred material for the nosepiece and skirt is a cemented carbide material such as tungsten carbide, the most preferred tungsten carbide alloy containing 11–14% cobalt. Both the nosepiece and the skirt can be made from the same material, or alternatively, different materials such as tungsten carbide alloys having different hardnesses. To facilitate this latter construction, the nosepiece and skirt can be manufactured separately, and joined together when brazed or otherwise attached to the tool body, or can be manufactured integrally as a single unitary member. One example of an optional layer or coating of a super hard material such as a diamond material or other material that can be placed on the outer work engaging surfaces of the nosepiece and/or the skirt for enhanced impact and wear resistance is a diamond material comprising a layer of polycrystalline diamond compact deposited on the surface of the nosepiece and/or skirt under high temperature and high pressure conditions as taught in my U.S. Pat. No. 5,161,627. Other examples of suitable diamond coatings include a layer or layers deposited using low temperature, low pressure methods such as a low pressure solid state source process; a chemical vapor deposition process; a physical deposition process; a plating process; and a cemented diamond dust coating process. Treatment of the nosepiece and/or skirt with a plasma carbonizing process can alternatively be used for enhanced hardness and wear resistance.

OBJECTS OF THE INVENTION

It is a principal object of the present invention to provide earth and mineral engaging attack tools which are more durable and longer lasting.

Another object is to reduce the frequency of downtime for tool changes to make mining and excavating and other applications involving attack tools more productive.

Another object is to provide attack tools which remain sharper longer and can effectively cut for longer time periods, are less prone to dulling and breaking, and produce less respirable dust.

Another object is to provide means for reducing the occurrence of insert and tip wash-out from attack tools.

Another object is to provide an improved tip design which is adaptable for use on a wide variety of different attack tools.

Another object is to provide an improved cutting tip construction for attack tools which is economical to use and make.

Another object is to provide mining attack tools which produce less sparking.

These and other objects and advantages of the present invention will become apparent to those skilled in the art after considering the following detailed specification in conjunction with the accompanying drawings wherein;

DETAILED DESCRIPTION OF THE PREFERRED EMBODIMENTS

Figure 1:
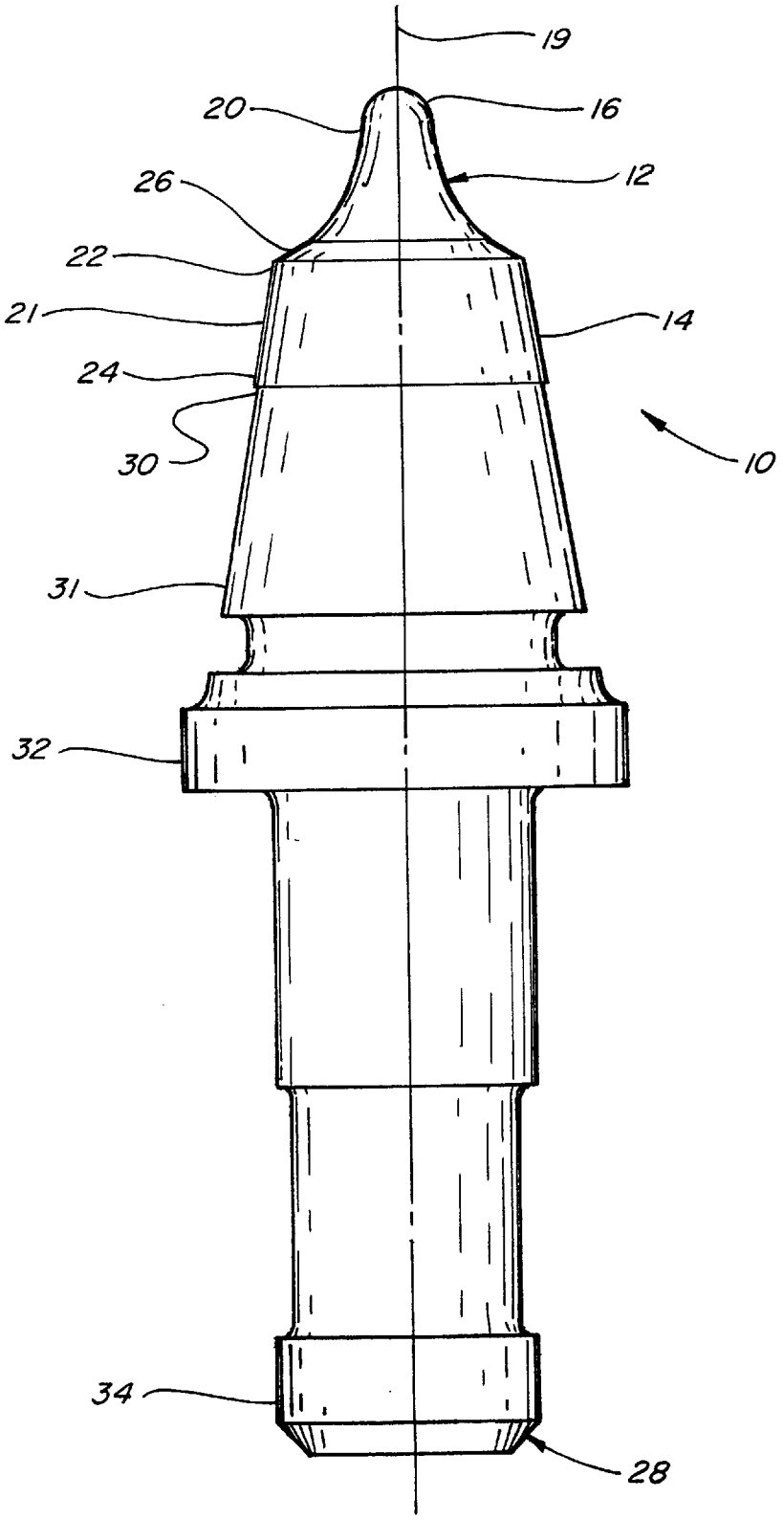
FIG. 1 is a side elevational view of one embodiment of a two piece nosepiece and skirt assembly constructed according to the teachings of the present invention shown mounted on a conventional mining attack tool body.

Referring to the drawings more particularly by reference numbers wherein like numerals refer to like parts, number 10 in FIG. 1 identifies a nosepiece and skirt assembly constructed according to the teachings of the present invention. The nosepiece and skirt assembly 10 is of two piece construction including a nosepiece 12 and a separate skirt 14. The assembly 10 is shown installed on the forward work engaging end portion of a mining attack tool body 28, the construction and operation of which tool is discussed in greater detail below. The assembly 10 mounted on a tool body such as the mining attack tool body 28 is suitable for coal mining and other applications and in tests has shown improved wear and longevity characteristics when compared to prior inserts and tips for such tools. Furthermore, the assembly 10 has been found to provide a more effective cutting capability, and one which produces a cleaner, better coal product with less production of respirable dust and sparking, and to be less prone to wash-out and dislodgment compared to prior inserts and tips.

Figure 2:
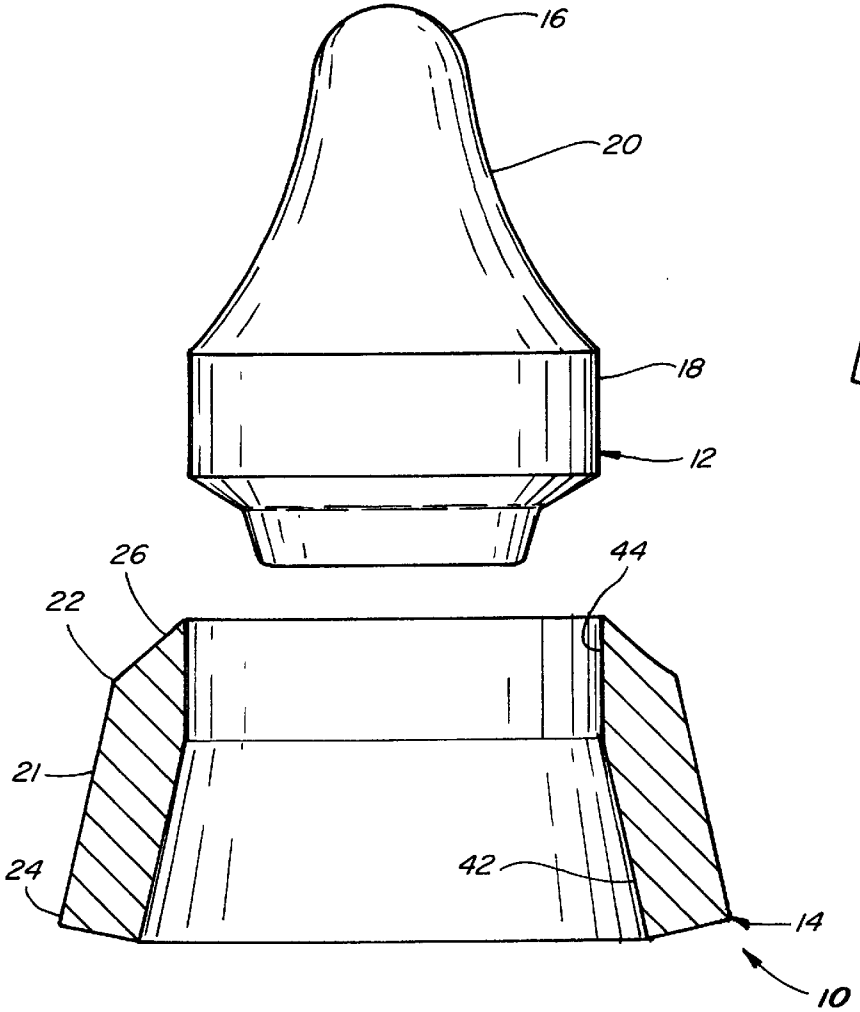
FIG. 2 is an enlarged exploded side elevational view of the nosepiece and skirt assembly of FIG. 1, showing the skirt in cross-section.

Referring also to FIG. 2, the nosepiece 12 of the assembly 10 is a solid member preferably made from tungsten carbide or a similar hard material. The nosepiece 12 includes a tip end portion 16 which has a generally hemispherical shaped outer surface, and an opposite base end portion 18 which is larger and has a cylindrical shape, both the tip end portion 16 and the base end portion 18 being concentric about a central longitudinal axis 19 of the tool body 28 (FIG. 1). The nosepiece 12 includes an intermediate portion 20 extending therearound from the tip end portion 16 to the base end portion 18, which intermediate portion 20 has a generally circular cross-sectional shape concentric with tip end portion 16 and base end portion 18 about axis 19. The intermediate portion 20 further has a generally concave sideward profile shape that curves gradually outwardly from the smaller tip end portion to the larger base end portion. Importantly, it has been found that the outer shape of intermediate portion 20 remains essentially the same as the nosepiece 12 wears during use, even as the overall length of the nosepiece becomes shorter, which gives the nosepiece its self-sharpening capability. The skirt 14 is also preferably made of tungsten carbide or like material and is an annular shaped member likewise concentric with portions 16, 18 and 20 about axis 19 and has an outer surface 21 with a tapered or frusto-conical shape extending from a smaller diameter forward end edge 22 to a larger diameter rear end edge 24. When installed on a mining attack tool, such as the attack tool 28 shown in FIG. 1, nosepiece 12 provides a generally smooth, contiguous outer surface extending from the tip end portion 16 to the edge 22 of the skirt 14, a smooth transition from the concave outer surface of the intermediate portion 20 of the nosepiece 12 to the leading edge 22 of the tapered outer surface 21 of the skirt 14 being provided by annular transition surface 26 on the forward end of the skirt to allow smooth material flow past the nosepiece.

Figure 3:
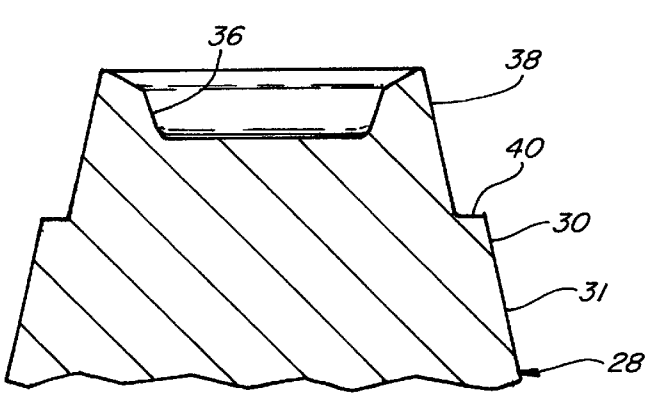
FIG. 3 is an enlarged fragmentary cross-sectional view of the work engaging end portion of the tool body of FIG. 1 with the present nosepiece and skirt assembly removed.

The nosepiece and skirt according to the present invention can be used with a variety of attack tools having different sizes and shapes suitable for use in mining, excavating and other purposes, the primary difference between attack tools for these different applications being mainly that of size or scale. Referring again to FIG. 1, the tool body 28 shown is a conventional coal mining attack tool body which can be mounted for rotation on the rotatable wheel or drum of a mining machine (not shown). The tool 28 includes a work engaging end portion 30 which has a frusto-conical shaped outer side surface 31 which tapers outwardly as it extends toward a collar 32, and a mounting end 34 opposite the work engaging end for mounting the tool on a mining machine. Referring now to FIG. 3, the work engaging end 30 of the tool body 28 includes a receptacle 36 shaped for cooperatively receiving and supporting a conventional replaceable cutting insert or tip having a correspondingly shaped base end portion (not shown). The present nosepiece 12 mounts in the socket 36. The only modification to the tool body 28 for the purposes of the present invention is the optional provision of a reduced diameter tapered or frusto-conical outer side surface portion 38 around work engaging end 30 adapted for cooperatively receiving the skirt 14, which surface portion 38 terminates at a step or shoulder 40.

Figure 4:
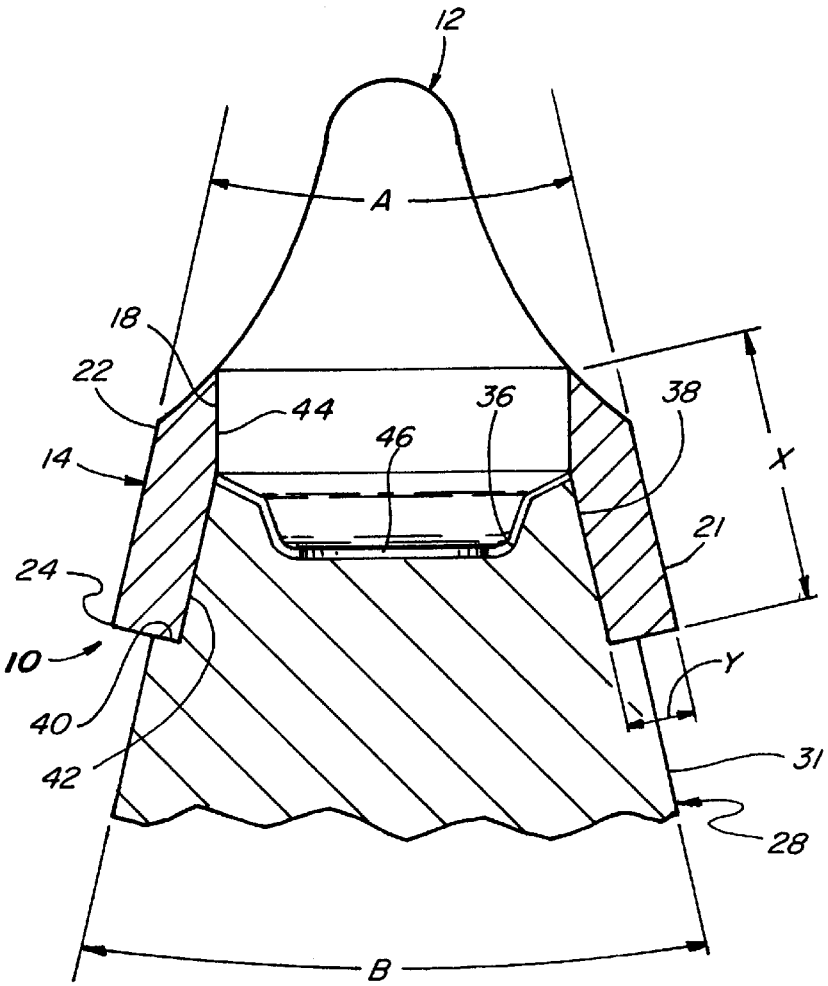
FIG. 4 is an enlarged fragmentary partial cross-sectional view of the nosepiece and skirt assembly of FIG. 1 shown in position to be brazed to the work engaging end portion of the tool body.

Referring also to FIG. 4, the skirt 14 has an inner annular tapered surface 42 corresponding in size and shape to the tapered surface 38 on the tool body 28. This enables the skirt 14 to be cooperatively received over work engaging end 30 of the tool body 28 in overlaying relation to the surface 38, the rear end edge portion 24 of the skirt 14 located in abutting relation to the shoulder 40 on the tool to hold the skirt in position while it is being attached, and to support the skirt during use. This overlaying relation is important as it enables the skirt 14, which is made of a much harder material than the tool body 28, to protect the outer side surface of the tool body from erosion and prevents wash-out of the nosepiece 12. The abutting relation of skirt 14 to shoulder 40 furthermore enables the skirt to more securely support and hold the nosepiece 12 in position. This is especially important to prevent dislodgment of the nosepiece under the immense forces encountered when mining.

Figure 5:
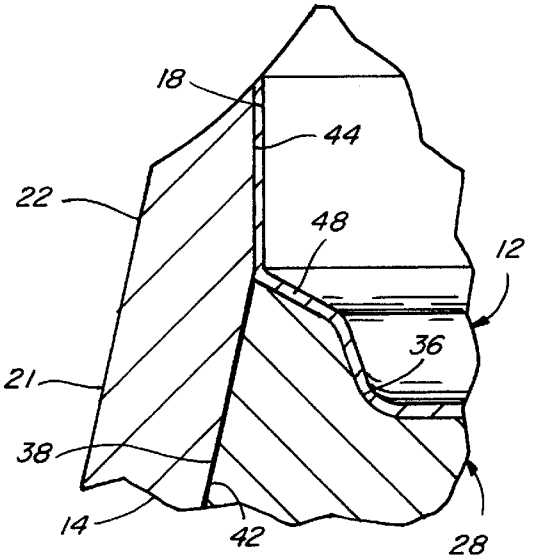
FIG. 5 is an enlarged fragmentary partial cross-sectional view of the nosepiece and skirt assembly of FIG. 1 brazed onto the tool body.

The skirt 14 includes an inner cylindrical surface portion 44 inwardly from forward end edge 22, which surface 44 is sized and shaped so as to cooperatively receive and envelope the cylindrical base portion 18 of the nosepiece 12. The nosepiece 12 and the skirt 14 can be attached to the tool body 28 using any suitable means, a preferred means of attachment being by brazing. One manner of brazing the nosepiece 12 and the skirt 14 to the tool body 28 is by the placement of a conventional brazing disc 46 on the support surface 36 under the nosepiece 12, and with the skirt 14 in position, heating the thus assembled members to melt the brazing disc 46 whereby the brazing material 48 from the melted disc can flow around the nosepiece 12 and between the surfaces 18 and 44 to bond the nosepiece and the skirt together and to securely attach both the nosepiece and the skirt onto the tool body, as shown in FIG. 5. Additional brazing material (not shown) can be added, for instance between the surfaces 38 and 42, to further strengthen the bond, as desired.

Figure 6:
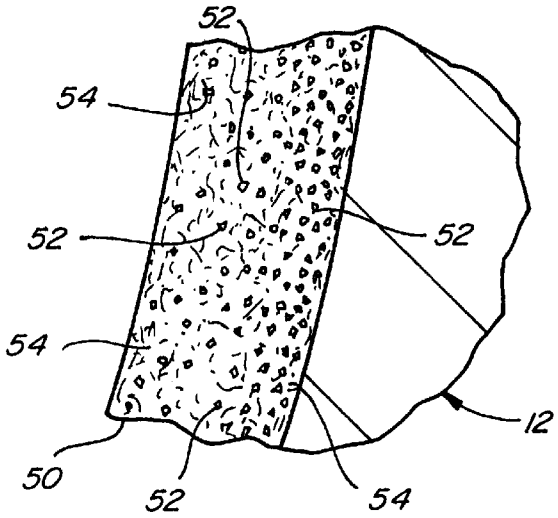
FIG. 6 is an enlarged fragmentary cross-sectional view of a portion of the nosepiece of FIG. 1, showing a layer of PCD compact on the outer work engaging surface thereof.

The outer work engaging surfaces of the nosepiece 12 and/or the skirt 14 can be provided with a layer of a super hard material such as a material that includes particles of diamond to reduce wear and to enhance the longevity of the assembly 10. Referring to FIG. 6, one preferred diamond layer 50 is formed of a polycrystalline diamond (PCD) compact. The layer of PCD compact 50 is a composite including carbide particles or pieces 52 interspersed with diamond crystals 54 which layer is formed by heat and pressure, such as taught in Hall et al. U.S. Pat. No. 4,604,106, and as further explained in my U.S. Pat. No. 5,161,627. The PCD compact 50 preferably has a percent volume or concentration of carbide which is greatest adjacent to the surface of the tungsten carbide nosepiece 12 and lesser toward the outer surface of the layer, with the outer surface preferably comprised substantially entirely of polycrystalline diamond particles.

Figure 7:
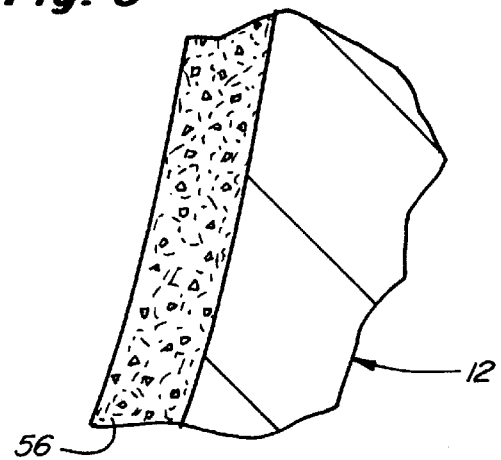
FIG. 7 is another enlarged fragmentary cross-sectional view of the nosepiece of FIG. 1, showing an alternative diamond layer embodiment on the outer work engaging surface thereof.

Referring to FIG. 7, an alternative diamond layer 56 is shown. The diamond layer 56 can be thinner than the PCD compact layer 50 shown in FIG. 6 and is representative of diamond particles mixed with a binder plated or otherwise attached to the outer surface of the nosepiece. This can be done using a low temperature, low pressure process such as a low pressure solid state source process for diamond synthesis, or a chemical vapor deposition process.

As mentioned above, the nosepiece and skirt members according to the present invention can be made from a variety of different hard materials and can have various shapes for different mining, excavating and other applications. For instance, it has been found that making the nosepiece from one commercially available grade or hardness of carbide material and the skirt from another such as a less hard grade can have advantage for some mining operations. Additionally, the skirt according to the present invention can have a variety of different shapes and sizes for different applications. For instance, the skirt 14 has an outer tapered surface angle as measured between the opposite surfaces thereof identified by the letter "A" in FIG. 4, which angle A corresponds to the angle subtended by the opposite portions of the tapered outer surface of the tool body 28, identified by the letter "B". The angle "A", as well as the length of the outer sidewall of the skirt 14, identified by the letter "X", and the thickness of the skirt, identified by the letter "Y", can be tailored, so as to provide an expected skirt life corresponding to the expected effective life of a particular nosepiece under certain mining or excavating conditions. In any event, the skirt length X and the skirt thickness Y should be selected so as to be sufficient to prevent wash-out of the side of the tool body for a period of operation corresponding to the expected effective life of the nosepiece.

As a practical example, a skirt having a length X in a range from about 0.200 inch to about 0.400 inch or greater and a thickness Y of about 0.160 inch has been found to provide satisfactory results for some coal mining applications. Furthermore, a skirt having an outer surface angle A of about 25° corresponding to the outer surface angle B of a variety of conventional coal mining attack tools has been found satisfactory, although other values for this angle could likewise be used.

Figure 9:
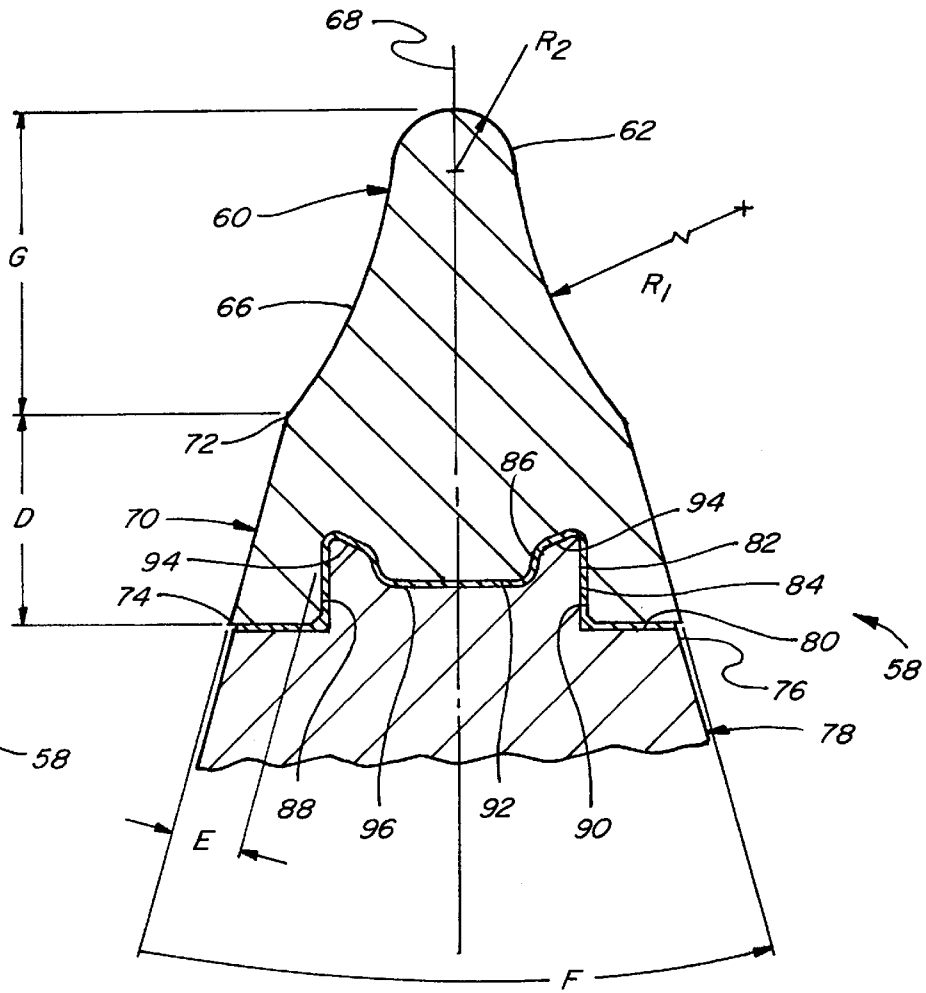
FIG. 9 is an enlarged fragmentary cross-sectional view of the nosepiece and skirt of FIG. 8 mounted on a conventional attack tool body.
Figure 8:
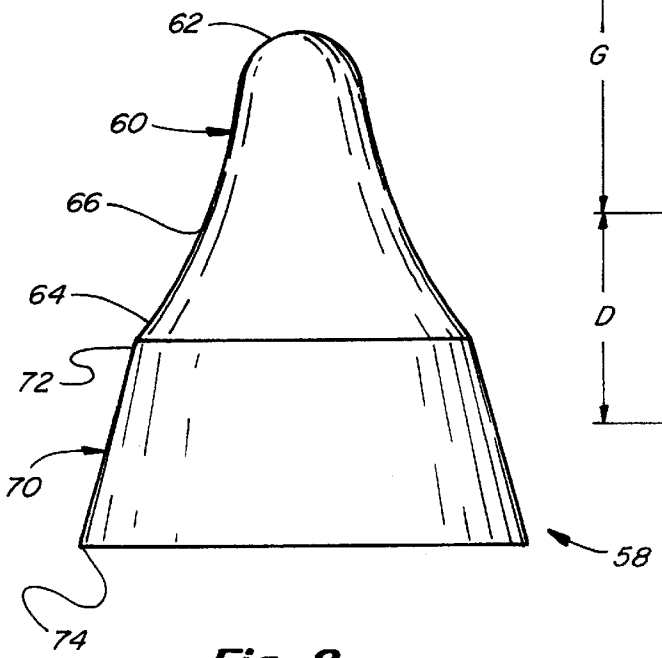
FIG. 8 is a fragmentary side elevational view of one embodiment of a one piece nosepiece and skirt constructed according to the teachings of the present invention.

FIGS. 8 and 9 show an alternative nosepiece and skirt embodiment 58 which is of one piece or unitary construction. Embodiment 58 includes a nosepiece portion 60 having a tip end 62, a larger opposite rearward end 64, and an intermediate portion 66 extending between the tip end 62 and opposite rearward end 64, portions 62–66 being round in cross-section and concentric about a central longitudinal axis 68 (FIG. 9). The tip end 62 has an outer surface of rounded shape, and the intermediate portion 66 has an outer surface extending therearound having a concave profile substantially tangent with the round outer shape of tip end 62 and curving progressively outwardly therefrom to the opposite rearward end 64, the shapes of tip end 62 and intermediate portion 66 providing the same self-sharpening and improved cutting capability of embodiment 10 above. A skirt 70 is located adjacent to the rearward end 64 of the nosepiece 60 and it has a frusto-conical shaped outer surface extending rearwardly and outwardly from a forward end 72 to an opposite rearward end 74. The outer surface of skirt 70 can have any desired tapered surface angle as measured between the opposite surfaces thereof, the preferred angle corresponding to that of the outer surfaces of a tool body on which the skirt is mounted, in the same manner as explained in reference to FIG. 4 above.

Referring to FIG. 9, embodiment 58 is shown mounted to an earth engaging end 76 of an attack tool body 78. Earth engaging end 76 of attack tool body 78 is circular in cross-section and includes an endwardly facing generally planar annular shoulder 80 extending around an annular raised lip 82. The raised lip 82 includes an outer cylindrical side surface 84 extending therearound and surrounds a centrally located endwardly facing receptacle 86. Skirt 70 is mountable to earth engaging end 76 of tool body 78 as shown, rearward end 74 of the skirt being positionable in abutting relation to annular shoulder 80 and including an annular groove 88 adapted for cooperatively receiving lip 82. Groove 88 of the skirt is defined on one side by a cylindrical inner side surface 90 positionable in overlaying relation to the outer side surface 84 of the lip 82, and on the opposite side by a button 92 correspondingly sized and shaped to be cooperatively received in receptacle 86. Additionally, rearward end edge 74 of the skirt 70 includes a plurality of small bumps 94 at circumferencially spaced locations on the surface of groove 88, which bumps 94 maintain rearward end edge 74 in predetermined spaced relation to the corresponding surfaces on end 76 of tool body 78 to allow for the penetration of a uniform layer of brazing material 96 therebetween for the attachment of nosepiece and skirt 58 to tool body 78. When attached in this manner, embodiment 58 is securely locked onto tool body 78 and is less likely to be dislodged therefrom and lost. Additionally, the skirt 70 protects the outer sidewall 84 of tool body 78 from erosion and eventual wash-out prior to the end of the expected life of the nosepiece.

As a practical example, the embodiment 58 having a skirt portion 70 with a length "D" of about 0.500 inch and a thickness "E" of about 0.168 inch has been found to provide satisfactory results for some coal mining applications. Furthermore, a skirt having an outer surface angle "F" of about 31° corresponding to the outer surface angle of the conventional coal mining attack tool shown has been found to be satisfactory, although other values for this angle and the other dimensions recited above can be used. Additional dimensions of the embodiment 58 include a forward end 72 of the skirt 70 having a diameter of about 0.823 inch, a reward end 74 having a diameter of about 1.103 inch, the nosepiece portion 60 having a height of about 0.750 inch, concave intermediate portion 66 having a radius of $R_1$ of about 1.232 inch, and tip end 62 with a radius $R_2$ of 0.158 inch, although, again, as in the case of embodiment 10 above, other values for these dimensions could likewise be used.

Referring again to FIGS. 6 and 7, the outer surface of nosepiece 60 and/or skirt 70 can be provided with a layer of a super hard material such as the diamond layer 50 or the diamond layer 56, as well as other suitable hardened surfaces.

Thus there has been shown and described several embodiments of a nosepiece and skirt construction for an attack tool which fulfill all of the objects and advantages sought therefor. Many changes, modifications, variations, and other uses and applications of the present construction will, however, become apparent to those skilled in the art after considering this specification and the accompanying drawings. All such changes, modification, variations and other uses and applications which do not depart from the spirit and scope of the invention are deemed to be covered by the invention which is limited only by the claims which follow.

What is claimed is:

1. A nosepiece and skirt for mounting on a work engaging end of an attack tool having a support surface for receiving and supporting a cutting element to be installed thereon and an outer side surface extending around the work engaging end adjacent the support surface, the nosepiece and skirt comprising:

a nosepiece portion having a rearward end adapted for attachment to the support surface of the work engaging end of the attack tool and a forwardly extending work engaging end providing a cutting element having a concave outer side surface therearound extending from the rearward end to a smaller forwardmost tip, the tip having a rounded outer shape blending smoothly with the concave outer side surface, and an annular skirt portion formed integrally with the nosepiece portion and extending rearwardly from the nosepiece portion to protect the outer side surface of the tool from erosion, the skirt portion having an inner side surface located adjacent the rearward end of the nosepiece portion adapted for placement in overlaying relating to at least a portion of the outer side surface of the work engaging end of the attack tool and a frusto-conical outer side surface extending rearwardly and outwardly from the concave outer side surface of the work engaging end of the nosepiece portion.

2. The nosepiece and skirt of claim 1 wherein the attack tool support surface is located in a receptacle in the work engaging end of the tool and the rearward end of the nosepiece portion comprises a protuberance cooperatively receivable in the receptacle.

3. The nosepiece and skirt of claim 1 wherein the attack tool outer side surface is cylindrical shaped.

4. The nosepiece and skirt of claim 1 wherein the skirt portion has a rearward outer edge located radially outwardly of the outer side surface of the attack tool when attached thereto.

5. The nosepiece and skirt of claim 1 wherein the nosepiece portion and the skirt portion are made of a tungsten carbide alloy.

6. The nosepiece and skirt of claim 5 wherein the tungsten carbide alloy contains from about 11 to about 14% cobalt.

7. The nosepiece and skirt of claim 1 wherein at least the outer side surface and tip of the nosepiece portion are covered by a layer of material containing diamond particles.

8. The nosepiece and skirt of claim 1 wherein the work engaging end of the attack tool forms a forwardly extending annular protuberance around the support surface and the rearward end of the nosepiece portion comprises an annular groove adapted for cooperatively receiving the annular protuberance.

9. The nosepiece and skirt of claim 8 wherein the nosepiece portion further comprises a plurality of small circumferentially spaced bumps in the annular groove.

10. A self-sharpening nosepiece and skirt for mounting on an earth engaging end of a rotatable attack tool, the earth engaging end having an endmost portion including a support surface located in a recessed receptacle for receiving and supporting a tip to be installed thereon and an outer side surface extending around the endmost portion adjacent the support surface, the nosepiece and skirt comprising:

a nosepiece including a forward tip end having a rounded outer surface, a large rearward end, and an intermediate portion extending from the tip end to the rearward end, the intermediate portion having a concave outer side surface extending therearound which blends smoothly with the rounded outer surface of the tip end and curves increasingly outwardly toward the larger rearward end, and a skirt extending rearwardly from the nosepiece, the skirt including a rearwardly open cavity for receiving the endmost portion of the earth engaging end of the attack tool, a surface in the cavity attachable to the support surface of the tool, at least a portion of the surface in the cavity attachable to the support surface being located on a rearwardly extending button located in the capacity and cooperatively receivable in the recessed receptacle of the attack tool, and an inner side surface in the cavity positionable in overlaying relation around at least a portion of the outer side surface of the tool, the skirt having a frusto-conical outer side surface extending rearwardly and outwardly from the concave outer side surface of the nosepiece.

11. The self-sharpening nosepiece and skirt of claim 10 wherein the nosepiece and skirt are of unitary construction.

12. The self-sharpening nosepiece and skirt of claim 10 comprised of a cemented carbide material.

13. The self-sharpening nosepiece and skirt of claim 10 wherein the attack tool outer side surface is cylindrically shaped and the inner side surface of the skirt is correspondingly shaped and positionable in overlaying relation thereto.

14. An earth engaging attack tool mountable for rotation on a mining or excavating machine comprising:

a tool body having a forward end including an annular sidewall extending therearound, the sidewall including an inner surface forming a forwardly facing receptacle for receiving and supporting an earth engaging element and an outer side surface adjacent the forwardly facing receptacle, a nosepiece made of a harder material than the tool body having an earth engaging portion including a forward tip end having a rounded outer surface and an intermediate portion extending from the tip end to a larger rearward end secured in the forwardly facing receptacle of the tool body, the intermediate portion having a concave outer side surface extending therearound which blends smoothly with the rounded outer surface of the tip end and curves increasingly outwardly toward the rearward end, and an annular skirt made of a harder material than the tool body integrally formed with the nosepiece and extending rearwardly from the nosepiece to protect the outer side surface of the tool body from erosion, the skirt having an inner side surface located adjacent the rearward end of the nosepiece in overlaying relation to at least a portion of the outer side surface of the tool body and a frusto-conical outer side surface tapering rearwardly and outwardly from the concave outer side surface of the earth engaging end of the nosepiece.

15. The tool according to claim 14 wherein at least the outer surfaces of the nosepiece are covered by a layer of material containing diamond particles.

16. A self-sharpening nosepiece and skirt for mounting on an earth engaging end of a rotatable attack tool, the earth engaging end having an endmost portion including a support surface for receiving and supporting a tip to be installed thereon, an annular endwardly extending lip around the support surface, and an outer side surface extending around the endmost portion adjacent the support surface, the nosepiece and skirt comprising:

a nosepiece including a forward tip end having a rounded outer surface, a larger rearward end, and an intermediate portion extending from the tip end to the rearward end, the intermediate portion having a concave outer side surface extending therearound which blends smoothly with the rounded outer surface of the tip end and curves increasingly outwardly toward the larger rearward end, and a skirt extending rearwardly from the nosepiece, the skirt including a rearwardly open cavity for receiving the endmost portion of the earth engaging end of the attack tool, a surface in the cavity attachable to the support surface of the tool, an annular shaped recess in the cavity adapted for receiving the annular endwardly extending lip around the support surface of the earth engaging end of the attack tool, and an inner side surface in the cavity positionable in overlaying relation around at least a portion of the outer side surface of the tool, the skirt having a frusto-conical outer side surface extending rearwardly and outwardly from the concave outer side surface of the nosepiece.

17. The nosepiece and skirt of claim 16 wherein the nosepiece portion and the skirt portion are made of different tungsten carbide alloys.

18. The self-sharpening nosepiece and skirt of claim 16 wherein the nosepiece and skirt are of unitary construction.

19. The self-sharpening nosepiece and skirt of claim 16 comprised of a cemented carbide material.

20. The self-sharpening nosepiece and skirt of claim 16 wherein the attack tool outer side surface is cylindrically shaped and the inner side surface of the skirt is correspondingly shaped and positionable in overlaying relation thereto.

* * * * *